US005738064A

United States Patent [19]

Lowe et al.

[11] Patent Number: 5,738,064

[45] Date of Patent: Apr. 14, 1998

[54] VIBRATION WELD CHASSIS ASSEMBLY

[75] Inventors: Jon E. Lowe, Charlotte, N.C.; Kevin F. Beaulieu, Shreveport, La.

[73] Assignee: WCI Outdoor Products, Inc., Cleveland, Ohio

[21] Appl. No.: 559,447

[22] Filed: Nov. 15, 1995

[51] Int. Cl.[6] ..... F01P 1/02

[52] U.S. Cl. ..... 123/198 E; 30/381

[58] Field of Search ..... 30/381, 383; 123/198 E, 123/195 C, 185.3

[56] References Cited

U.S. PATENT DOCUMENTS

| | | | |
|---|---|---|---|
| 3,036,566 | 5/1962 | Dobbertin | 123/198 E |
| 3,525,373 | 8/1970 | Kobayashi | 173/162.1 |
| 4,285,309 | 8/1981 | Johansson | 123/198 E |
| 4,370,809 | 2/1983 | Takahashi et al. | 123/198 E |
| 4,382,333 | 5/1983 | Nagashima et al. | 30/381 |
| 4,393,589 | 7/1983 | Barkhult | 30/381 |
| 4,694,578 | 9/1987 | Kemmler | 123/2 |
| 4,700,480 | 10/1987 | Rangert et al. | 30/383 |
| 4,770,130 | 9/1988 | Nagashima | 123/41.67 |
| 4,785,539 | 11/1988 | Nagashima | 30/381 |
| 4,856,195 | 8/1989 | Grossman et al. | 30/369 |
| 4,964,217 | 10/1990 | Siede et al. | 30/383 |
| 5,029,393 | 7/1991 | Nagashima et al. | 30/383 |
| 5,212,886 | 5/1993 | Tasaki | 30/381 |
| 5,233,945 | 8/1993 | Wolf et al. | 123/41.7 |
| 5,243,764 | 9/1993 | Wieland | 30/383 |
| 5,595,153 | 1/1997 | Hoppner et al. | 30/381 |

*Primary Examiner*—David A. Okonsky

*Attorney, Agent, or Firm*—Pearne, Gordon, McCoy & Granger LLP

[57] ABSTRACT

A portable power tool is provided which includes a chassis defining an integral rear handle, a first chamber for lubricating oil generally at a front end of the chassis, a second chamber for fuel generally at a rear end of the chassis, and a recess between the first and second chambers. An internal combustion engine is secured to the chassis within the recess and a front handle is secured to the front end of the chassis. A chain saw unit is also secured to the front end of the chassis and is operably connected to the engine. The chassis includes right and left nylon plastic chassis sections which are vibrationally welded together.

20 Claims, 5 Drawing Sheets

Fig.5
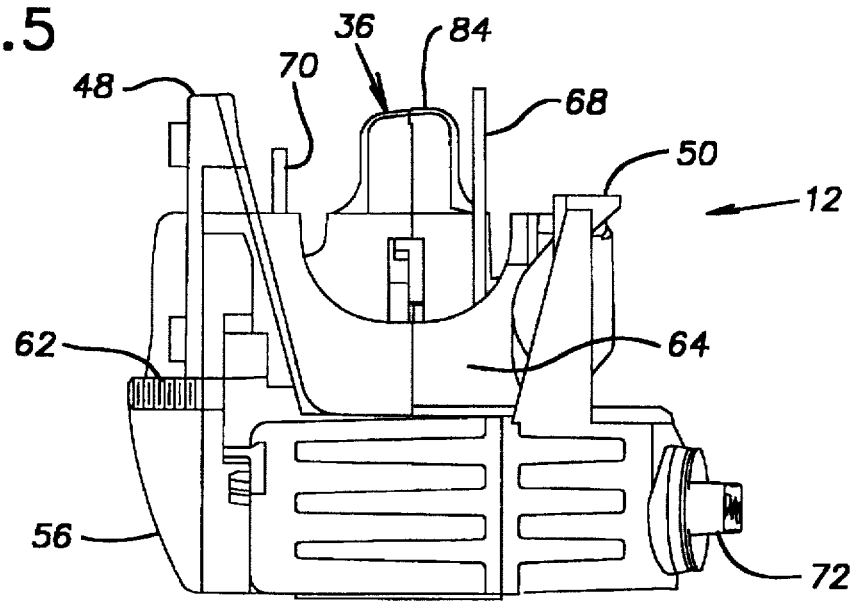
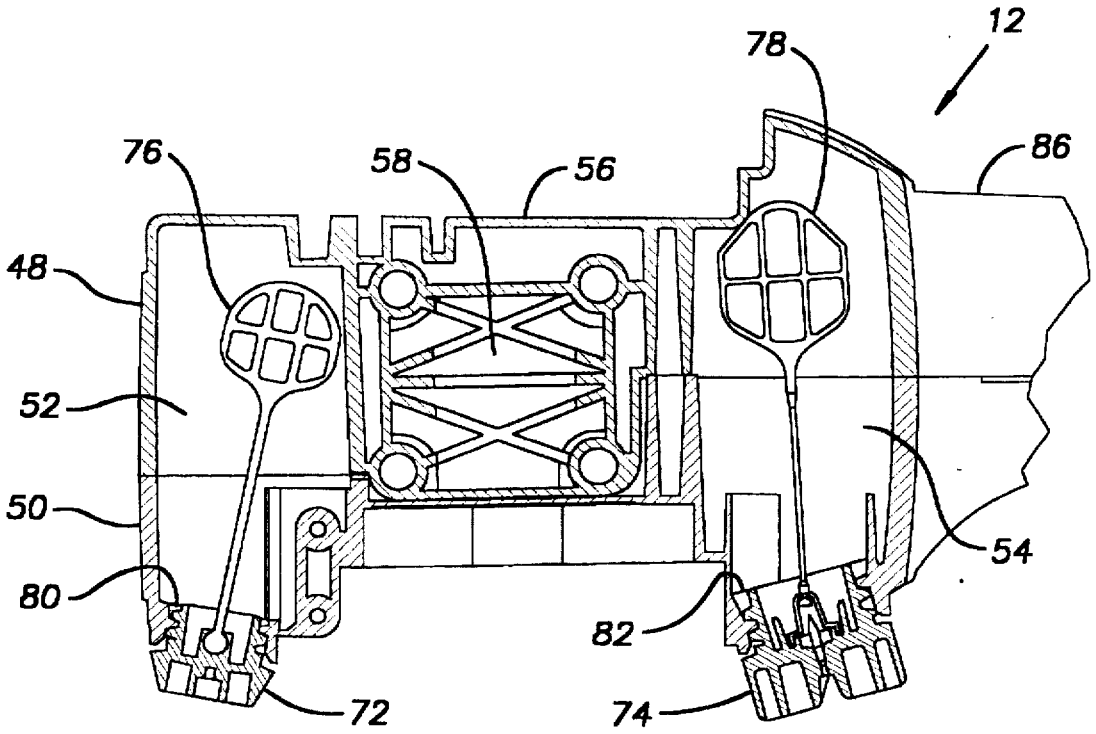
Fig.6

Fig.7
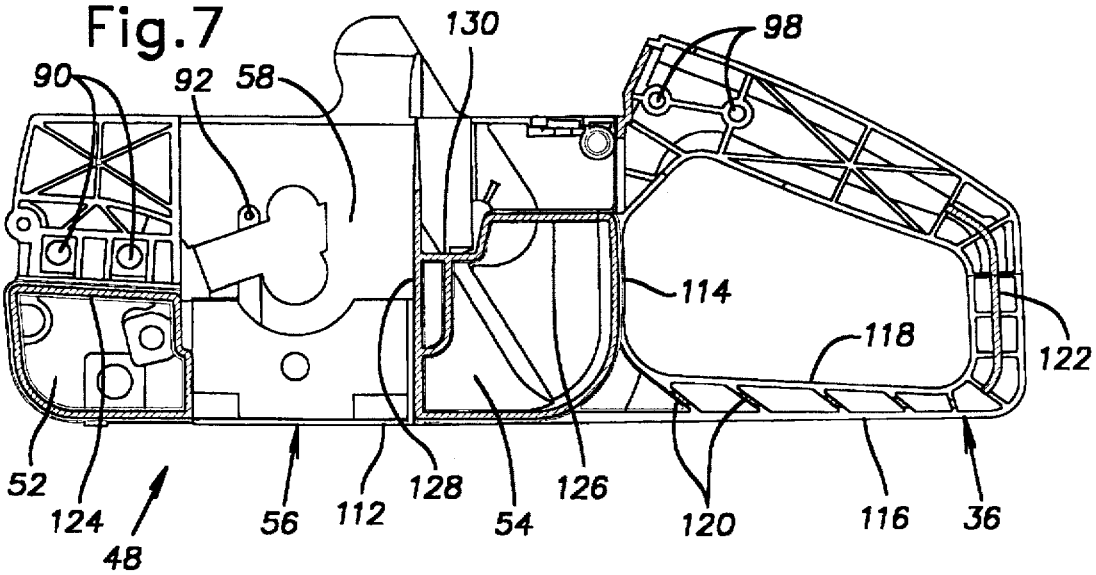
Fig.8
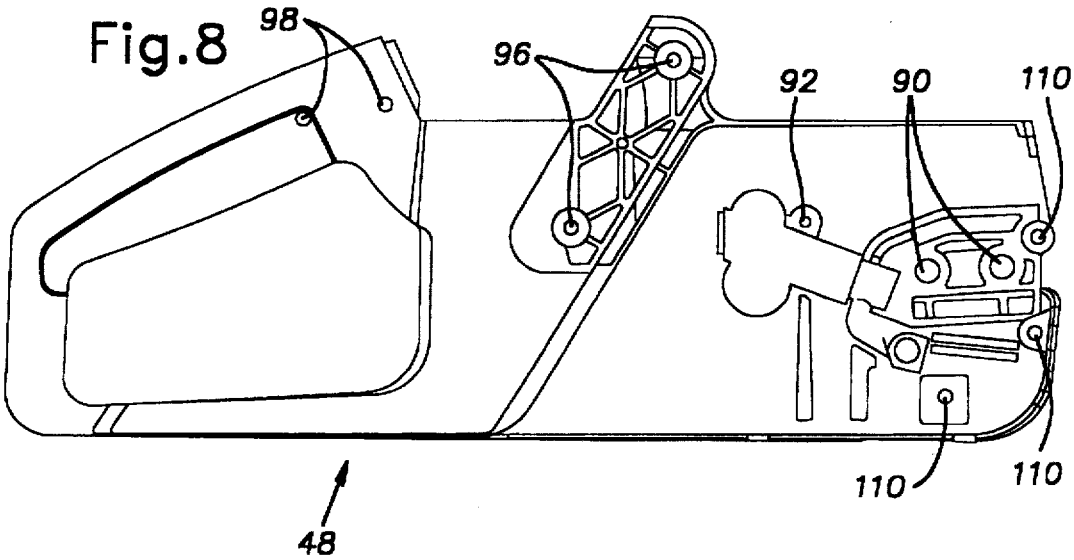
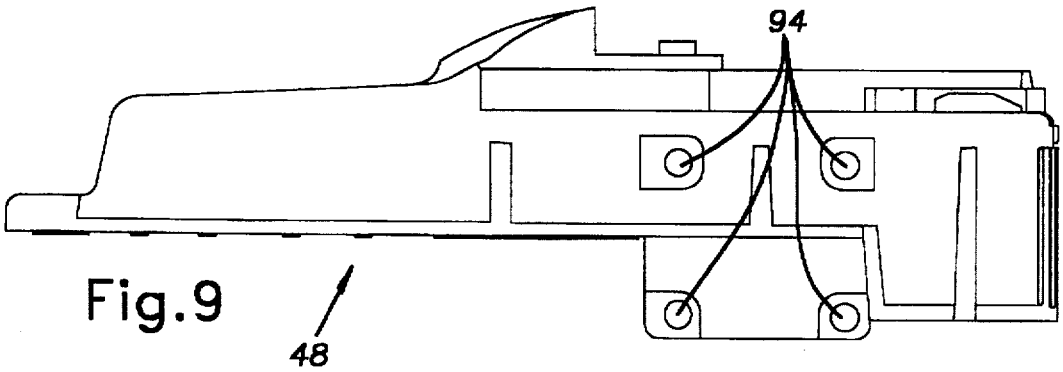
Fig.9

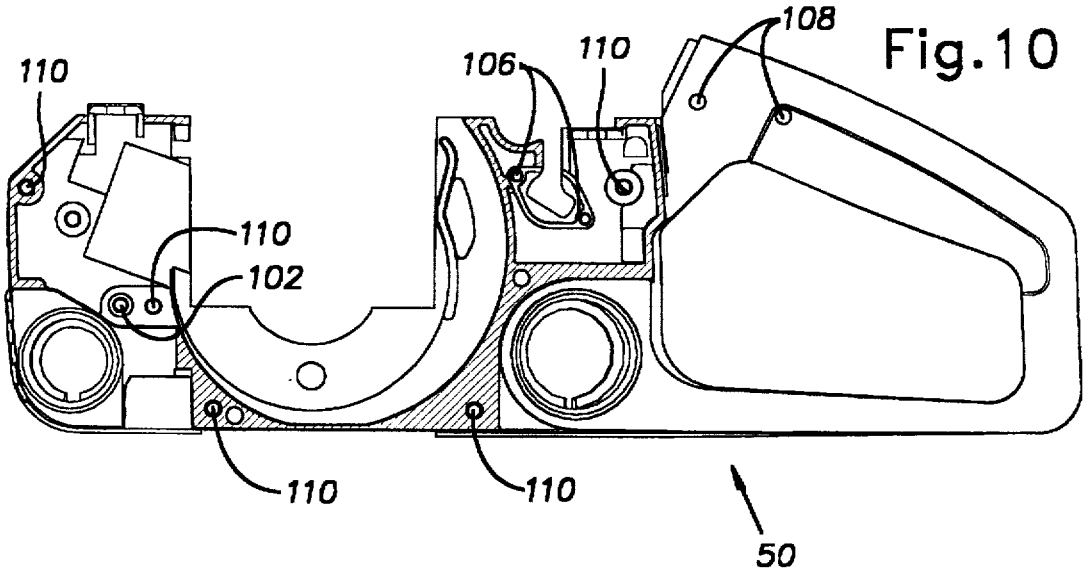
Fig.10
Fig.11
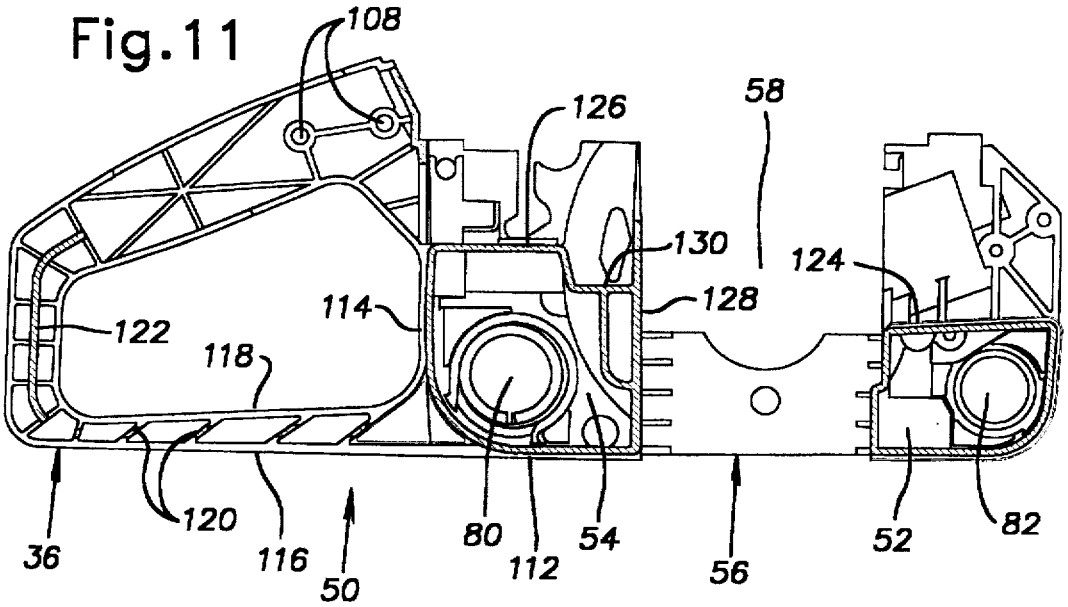
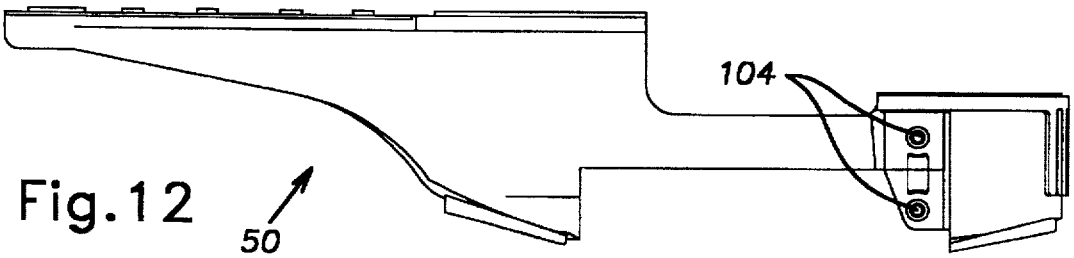
Fig.12

VIBRATION WELD CHASSIS ASSEMBLY

BACKGROUND OF THE INVENTION

1. Field of the Invention

The present invention relates to chassis assemblies for internal combustion engines and, more particularly, to chassis assemblies for the internal combustion engines of portable power tools.

2. Description of Related Art

In portable power tools, such as chain saws, significant attention has been paid to housings or chassis assemblies which are the main structural bodies to which the internal combustion engines are mounted. Typically, the chassis assemblies form cavities for lubricating oil and fuel and provide mounting locations for various control and operational elements, such as the engine and handles.

One type of chassis assembly is taught in U.S. Pat. No. 5,029,393, the disclosure of which is expressly incorporated herein in its entirety by reference, which shows a chassis assembly having cast upper and lower housings interconnected by vibration absorbing elements. The upper housing includes an internal oil tank and has the engine mounted thereto. The lower housing includes an internal fuel tank and has a rear handle mounted thereto. The vibration damping elements between the upper and lower housings obtain a high degree of vibration damping. This type of chassis assembly, however, requires a relatively large number of components and as a result is relatively expensive to manufacture.

Another type of chassis assembly is taught in U.S. Pat. Nos. 4,285,309 and 4,393,589, the disclosures of which are expressly incorporated herein in their entirety by reference, which show a chassis assembly having a single housing composed of upper and lower housing sections joined along a substantially horizontal dividing plane. Together the housing sections form an internal lubricating oil tank and an internal fuel tank. The horizontal dividing plane enables the engine to be mounted to a single housing section reducing the required manufacturing accuracy and rigidity of the housing sections. This type of chassis assembly, however, has a rear handle mounted to the housing such that a relatively large number of components are required and as a result the chassis assembly is relatively expensive to manufacture.

Yet another type of chassis assembly is taught in U.S. Pat. No. 4,285,309, the disclosure of which is expressly incorporated herein in its entirety by reference, which shows a chassis assembly having a single injection molded housing. The housing forms internal lubricating oil and fuel tanks while an engine and handles are mounted thereto. This type of chassis assembly, however, has a relatively complex and expensive method of manufacture.

Therefore, there exists a need in the art for an improved chassis assembly which has a reduced number of components and is relatively inexpensive and simple to manufacture and assemble relative to the presently known chassis assemblies.

SUMMARY OF THE INVENTION

The present invention provides a portable power tool which eliminates some or all of the above described shortcomings of the related art. The portable power tool includes a chassis defining an integral rear handle, a first chamber for lubricating oil generally at a front end of the chassis, a second chamber for fuel generally at a rear end of the chassis, and a recess between the first and second chambers. An internal combustion engine is secured to the chassis within the recess and a front handle is secured to the chassis generally at the front end of the chassis. A chain saw unit is secured to the front end of the chassis and is operably connected to the engine. The chassis includes a single housing formed by right and left chassis sections which are joined together. In a preferred embodiment, the right and left chassis sections are vibrationally welded together.

BRIEF DESCRIPTION OF THE DRAWINGS

These and further features of the present invention will be apparent with reference to the following description and drawings, wherein:

FIG. 5 is a forward end elevational view of the chassis assembly shown FIGS. 3 and 4;

FIG. 6 is a cross-sectional view of the chassis assembly as seen from line 6—6 of FIG. 4;

FIG. 7 is an interior elevational view of a first or right chassis section of the chassis assembly shown in FIG. 3;

FIG. 8 is an exterior elevational view of the right chassis section shown in FIG. 7;

FIG. 9 is a bottom plan view of the right chassis section shown in FIGS. 7 and 8;

FIG. 10 is an exterior elevational view of a second or left chassis section of the chassis assembly shown in FIG. 3;

FIG. 11 is an interior elevational view of the left chassis section shown in FIG. 10; and FIG. 12 is a bottom plan view of the left chassis section shown in FIGS. 10 and 11.

DETAILED DESCRIPTION OF THE PREFERRED EMBODIMENT

Figure 1:
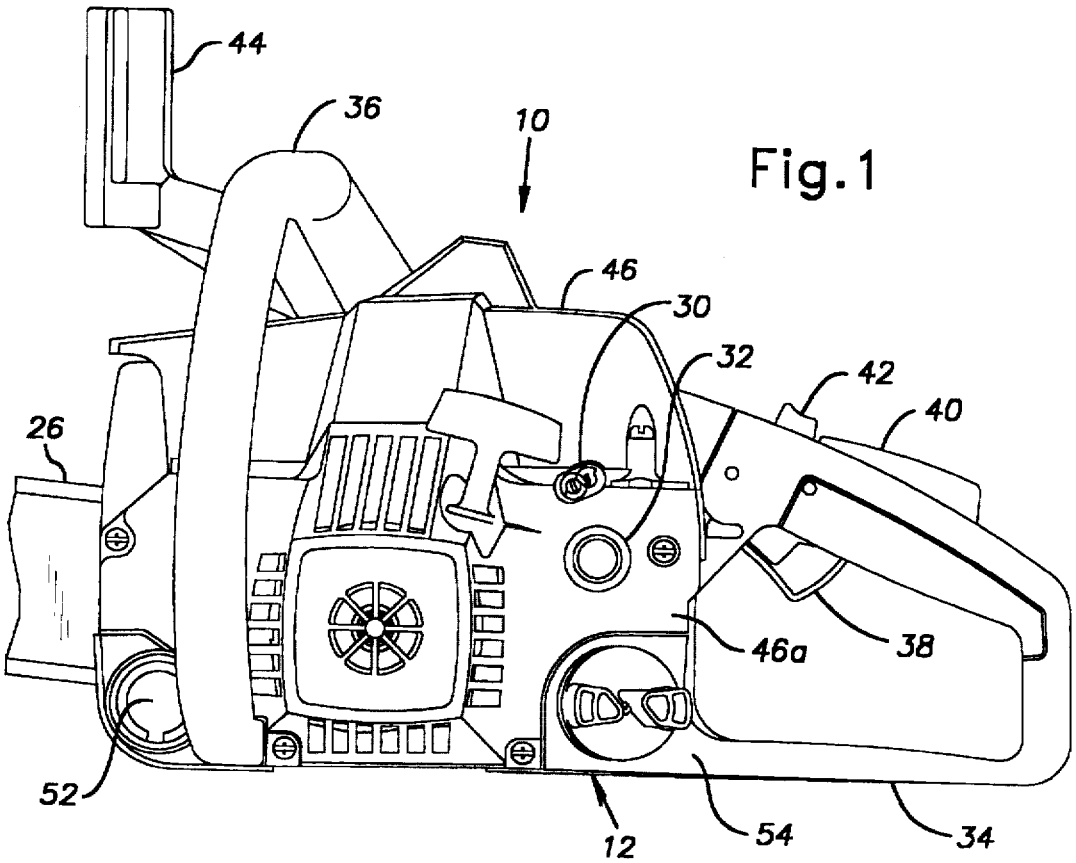
FIG. 1 is a left side elevational view of a portable power tool incorporating the present invention.
Figure 2:
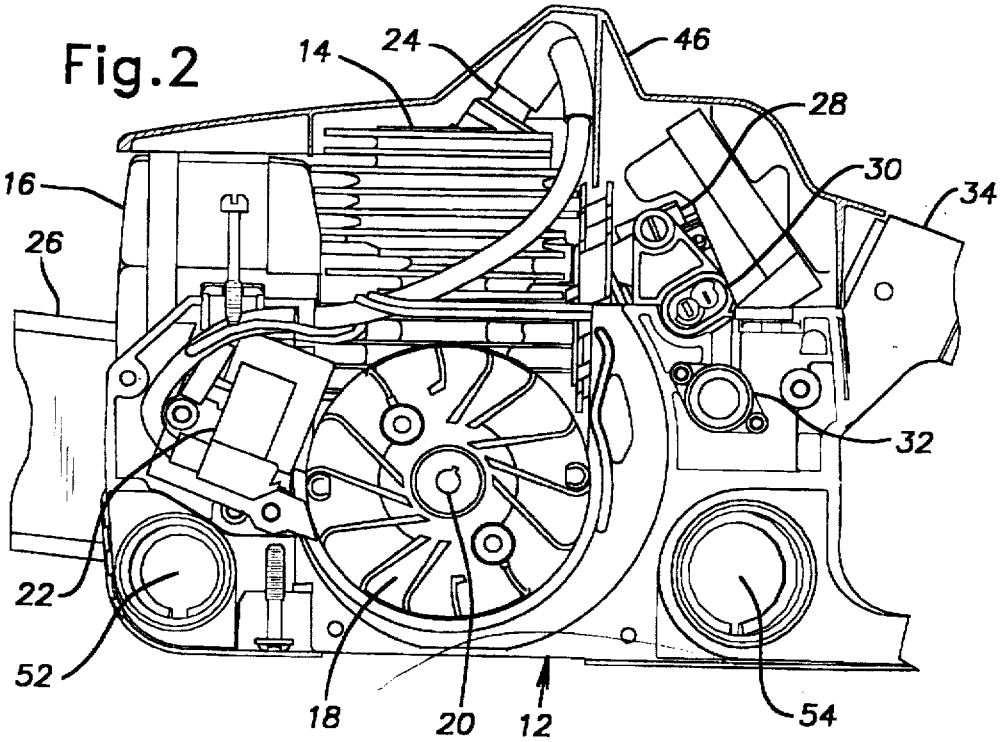
FIG. 2. is an enlarged left side elevational view of the portable power tool shown in FIG. 1, with portions removed for clarity.

FIGS. 1 and 2 illustrate a portable power tool 10 which incorporates a chassis assembly 12 according to the present invention. An internal combustion engine 14 is mounted to the chassis assembly 12 and has a muffler 16 at a forward end of the chassis assembly 12. A fan or flywheel 18 is mounted to a crankshaft 20 extending from the engine 14 on the left side of the chassis assembly 12, and is rotationally driven by the crankshaft 20. An ignition module 22 is mounted to the chassis assembly 12 adjacent the flywheel 18 and supplies spark-producing current pulses to a spark plug 24 as the flywheel 18 rotates, as is well known in the art. A guide bar/chain saw assembly 26 is mounted to the chassis assembly 12 adjacent the crank shaft 20, and is operably connected to the crank shaft 18 such that it is rotationally driven by the crankshaft 18. A carburetor 28 for the engine 14 is preferably mounted to the chassis assembly 12 at a rear end of the chassis assembly 12. The carburetor 28 is provided with adjustment screws 30 and an air purge or primer bulb 32, as is well known in the art.

An integral rear handle 34 is provided by the chassis assembly 12 and a front or upper handle 36 is mounted to the chassis assembly 12. A throttle trigger 38 with a lock-out switch 40 and a kill switch 42 are mounted to the rear handle 34. A hand guard 44 is located adjacent the front handle 36 as is well known in the art. A series of guards or covers 46, including a protective fan cover 46*a*, are secured to the chassis assembly 12 by conventional fasteners, as illustrated.

Figure 3:
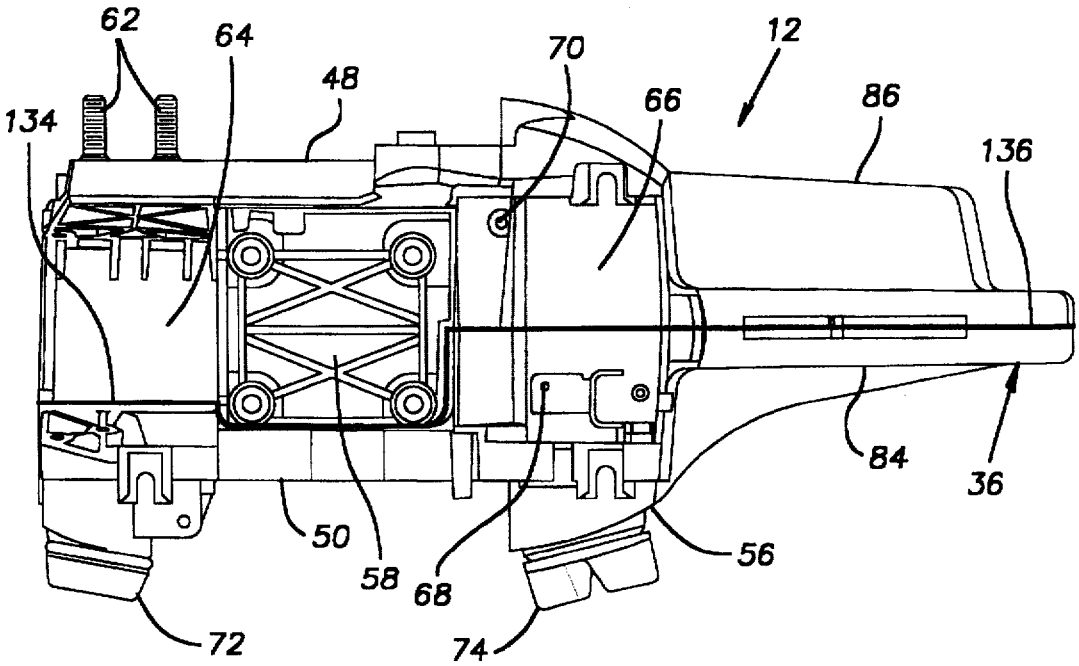
FIG. 3 is a top plan view of a chassis assembly of the portable power tool shown in FIGS. 1 and 2.
Figure 4:
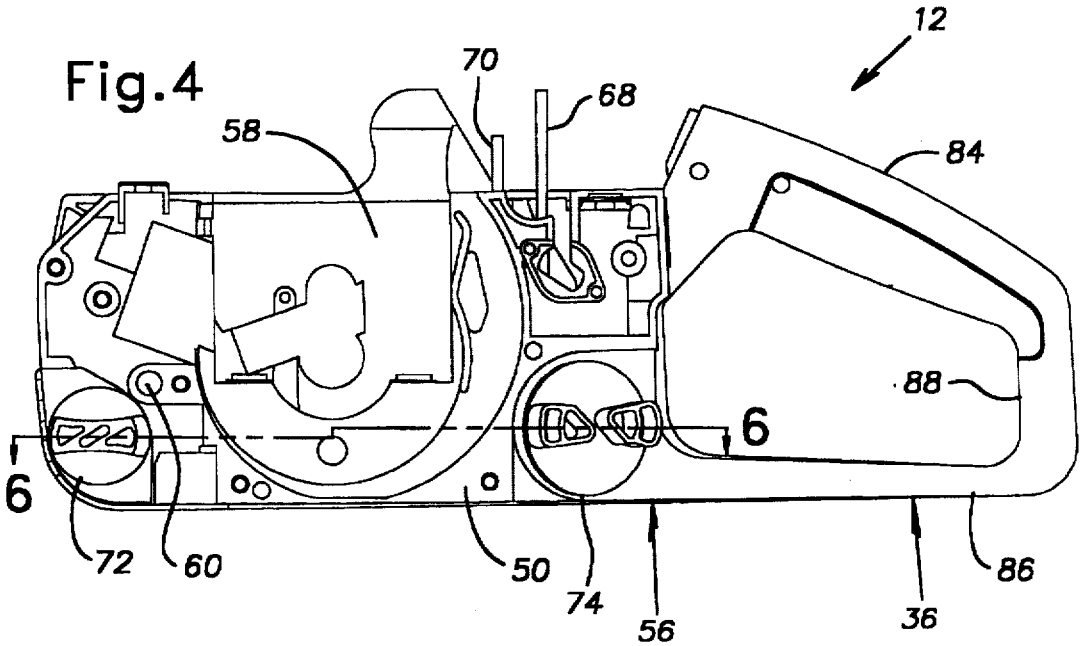
FIG. 4 is a left side elevational view of the chassis assembly shown in FIG. 3.

As best shown in FIGS. 3–6, the chassis assembly 12 includes a first or right chassis section 48 and a second or left chassis section 50. The chassis sections 48, 50 are preferably injection molded or die cast from a high rigidity synthetic resin of reduced weight and adequate strength such as, for example, nylon plastic. The chassis sections 48, 50 cooperate to define or provide a lubricating oil tank 52 and a fuel tank 54 in a body portion 56 of the chassis assembly 12 and the rear handle 36. Portions of the oil and fuel tanks 52, 54 and the rear handle 36 are provided by and defined by both the right and left chassis sections 48, 50. The chassis sections 48, 50 also cooperate to define or provide a recess 58 substantially at the center of the body portion 56 and into which a lower portion of the crankcase of the engine 14 is mounted. As best shown in FIG. 3, the right and left chassis sections 48, 50 are formed such that the engine 14 is mounted solely to the right chassis section 48. Mounting the engine 14 to a single chassis section enables the required manufacturing accuracy and rigidity of the chassis sections 48, 50 to be reduced. As best seen in FIG. 3, the parting or dividing surface between the chassis sections 48, 50 is substantially at the lateral center of the chassis assembly 12 rearwardly of the engine recess 58, is to the left the engine recess 58, and is leftwardly offset from the lateral center of the chassis assembly a distance less than at the engine recess 58 forward of the engine recess 58. The dividing surface, therefore, is substantially vertical but does not form a plane.

The lubricating oil tank 52 is located at a forward end and a lower portion of the body portion 56. An oil vent plug/check valve 60 is provided in the second chassis section 50 for venting the lubricating oil tank 52 to atmosphere. A pair of laterally extending studs 62 are provided in the first chassis section 48 above the lubricating oil tank 52 for mounting the guide bar/chain saw assembly 26. A recess 64 is formed above the oil tank 52 for receiving a lower portion of the muffler 16. The fuel tank 54 is located at a rear end and a lower portion of the body portion 56. A carburetor air box 66 for receiving the carburetor 28 is formed above the fuel tank 54 and fuel pick-up 68 and return lines 70 extend upward from the fuel tank 54 into the carburetor air box 66. Caps 72, 74 with retainers 76, 78 are provided for removably closing off openings 80, 82 of the lubricating oil and fuel tanks 52, 54.

The rear handle 36 extends from the rear end of the body portion 56. The handle 36 includes an engaging portion 84 which angles upwardly in a forward direction, a shield portion 86 which is substantially horizontal below the engaging portion 84, and a connecting portion 88 which is substantially vertical and integrally connects the rear ends of the engaging and shield portions 84, 86. The front end of the engaging portion 84 is integrally connected with the rear end of the body portion 56 adjacent the carburetor air box 66. The front end of the shield portion 86 is integrally connected with the rear end of the body portion 56 adjacent the fuel tank 54.

The right chassis section 48, best shown in FIGS. 7–9, and the left chassis section 50, best shown in FIGS. 10–12, provide mounting locations for the various control and operational elements. The right chassis section 48 provides mounting locations for the guide bar/chain saw assembly 26, an oil pump (not shown), the engine 14, an upper or right end of the front handle 36, and the throttle trigger and switches 38, 40, 42. The mounting location for the guide bar/chain saw assembly 26 includes openings 90 for the studs 62. The mounting location for the oil pump includes fastener receiving opening 92. The mounting location for the engine 14 includes fastener and metal insert receiving openings 94. The mounting location for the front handle 36 includes fastener receiving openings 96. The mounting location for the throttle trigger and switches 38, 40, 42 includes fastener receiving openings 98.

The left chassis section 50 provides mounting locations for the ignition module 22, the oil vent plug/check valve 60, a lower or left end of the front handle 36, the primer bulb 32, and the throttle trigger and switches 38, 40, 42. The mounting location for the ignition module 22 includes fastener receiving openings 100. The mounting location for oil vent plug/check valve 60 includes an opening 102. The mounting location for the front handle 36 includes fastener receiving openings 104. The mounting location for the primer bulb 32 includes fastener receiving openings 106. The mounting location for the throttle trigger and switches 38, 40, 42 includes fastener receiving openings 108 that cooperate with the openings 98 in the right chassis section 48. Each of the chassis sections 48, 50 also include a series of fastener receiving bosses 110 to facilitate mounting of the protective guards or covers 46, 46*a*.

Each of the chassis sections 48, 50 have a substantially horizontal base wall 112 that extends the length of the base portion 56. The base wall 112 partially forms the oil and fuel tanks 52, 54. A substantially vertical end wall 114 is provided at the rear end of the base portion 56 and partially forms the fuel tank 52. The rear handle 36 includes spaced apart outer and inner walls 116, 118 that extend the full length of engaging, shield, and connecting portions 84, 86, and 88 (FIG. 4) of the rear handle 36. The outer wall 116 is integral with the base wall 112 at the shield portion 86 of the rear handle 36 and the end wall 114 at the engaging portion 84 of the rear handle 36. The inner wall 118 is integral with the end wall 114 at both the shield and engaging portions 86, 84 of the rear handle 36. A series of ribs 120 extend between and connect the inner and outer walls 116, 118 throughout the rear handle 36 and a rib 122 parallelly extends between the inner and outer walls 116, 118 at the connecting portion 88 and a portion of the engaging portion 84 of the rear handle 36. Within the shield portion 86 of the rear handle 36, the ribs 120 angle upwardly in a forward direction. An oil tank wall 124 and a fuel tank wall 126 partially form the oil and fuel tanks 52, 54 respectively. The oil tank wall 124 and the fuel tank wall 126 also partially form the forward and rear ends of the engine recess 58. A substantially vertical wall 128 is provided between the fuel tank 54 and the engine recess 58 and is connected to the fuel tank wall 126 generally at the vertical center of the body portion 56 by a substantially horizontal wall 130. The vertical wall 128 partially forms the rear end of the engine recess 58.

With reference to FIGS. 7 and 11, the highlighted surfaces on each chassis section 48, 50 identify substantially vertical contact surfaces of the chassis sections 48, 50 which are joined together in a water tight fashion. The surfaces that are joined include the oil and fuel tank walls 124, 126, the vertical and horizontal walls 128, 130, a portion of the angled ribs 120 located within the shield portion 86 of the rear handle 36, the rib 122 within the rear handle 36, and a portion 132 of the outer wall of the rear handle 36 at the forward end of the engaging portion 84 of the rear handle 36. As best shown in FIG. 3, the joined surfaces define two substantially vertical, parallel, and laterally offset planes 134, 136 on opposite sides of the engine recess 58. The planes 134, 136 could alternatively be coplanar, however it may result in a reduced rigidity of the chassis assembly 12. It is noted that the surfaces which are joined are substantially on interior walls of the chassis sections 48, 50.

The left and right chassis sections 48, 50 are joined together by welding, however, any suitable means for joining the chassis sections 48, 50 can alternatively be utilized such as, for example, mechanical fasteners or adhesives. Preferably, the chassis sections 48, 50 are vibrationally welded together to produce strong and air-tight joints.

Although particular embodiments of the invention have been described in detail, it will be understood that the invention is not limited correspondingly in scope, but includes all changes and modifications coming within the spirit and terms of the claims appended hereto.

What is claimed is:

1. A portable power tool comprising:

a chassis defining an integrally molded rear handle forming a closed loop at a rear end of said chassis, a first chamber for lubricating oil generally at a front end of said chassis, a second chamber for fuel generally at a rear end of said chassis, and a recess between said first and second chambers, said chassis including right and left chassis sections which are joined together, wherein each of said chassis sections is molded of a plastic and said chassis sections are welded together only at said rear handle, said first chamber, said second chamber, and said recess;

an internal combustion engine secured to said chassis within said recess; and a front handle secured to said chassis; and a chain saw unit secured to the front end of said chassis and operably connected to said engine.

2. The portable power tool according to claim 1 wherein said right and left chassis sections are formed from nylon plastic.

3. The portable power tool according to claim 1, wherein said right and left chassis sections are vibrationally welded together.

4. The portable power tool according to claim 1, wherein said right and left chassis sections are joined at substantially vertical surfaces.

5. The portable power tool according to claim 1, wherein said engine is secured to only one of said right and left chassis sections.

6. The portable power tool according to claim 1, wherein said right and left chassis sections are joined around said first and second chambers to form an air tight seal.

7. The portable power tool according to claim 1, wherein said right and left chassis sections are joined at substantially vertical and laterally offset planes.

8. The portable power tool according to claim 1, wherein said rear handle has interior ribs and said right and left chassis sections are joined at a portion of said ribs.

9. The portable power tool according to claim 1, wherein said chassis has a generally planar base wall and a generally planar end wall and said rear handle is integral with said base wall and said end wall.

10. The portable power tool according to claim 1, wherein said portable power tool is made by a process including the steps of forming said right and left chassis sections from nylon plastic and joining said right and left chassis sections by vibrational welding.

11. A chassis for a portable power tool internal combustion engine, said chassis comprising right and left chassis sections joined together to form an integrally molded rear handle forming a closed loop at a rear end of said chassis, a first chamber for lubricating oil generally at a front end of said chassis, a second chamber for fuel generally at a rear end of said chassis, and a recess between said first and second chambers for receiving the engine, wherein each of said chassis sections is molded of plastic and said chassis sections are only welded together at said rear handle, said first chamber, said second chamber, and said recess.

12. The chassis according to claim 11, wherein said right and left chassis sections are formed from nylon plastic.

13. The chassis according to claim 11, wherein said right and left chassis sections are vibrationally welded together.

14. The chassis according to claim 11, wherein said right and left chassis sections are joined at substantially vertical surfaces.

15. The portable power tool according to claim 11, further comprising means for securing the engine to only one of said right and left chassis sections.

16. The chassis according to claim 11, wherein said right and left chassis sections are joined around said first and second chambers to form an air tight seal.

17. The chassis according to claim 11, wherein said right and left chassis sections are joined at a pair of substantially vertical and laterally offset planes.

18. The chassis according to claim 11, wherein said rear handle has interior ribs and said right and left chassis sections are joined at a portion of said ribs.

19. The chassis according to claim 11, wherein said chassis has a generally planar base wall and a generally planar end wall and said rear handle is integral with said base wall and said end wall.

20. The chassis according to claim 11, wherein said chassis is made by a process including the steps of forming said right and left chassis sections from nylon plastic and joining said right and left chassis sections by vibrational welding.

* * * * *